US005996253A

United States Patent [19]

Spector

[11] Patent Number: 5,996,253

[45] Date of Patent: Dec. 7, 1999

[54] ADJUSTABLE INNERSOLE FOR ATHLETIC SHOE

[76] Inventor: Donald Spector, 380 Mountain Rd., Union City, N.J. 07080

[21] Appl. No.: 09/144,603

[22] Filed: Aug. 31, 1998

[51] Int. Cl.[6] ..... A43B 13/20; A43B 13/18

[52] U.S. Cl. ..... 36/27; 36/28; 36/29

[58] Field of Search ..... 36/27, 28, 29, 36/35 B, 3 B

[56] References Cited

U.S. PATENT DOCUMENTS

| | | |
|---|---|---|
| 1,596,923 | 8/1926 | Cooney . |
| 2,020,240 | 11/1935 | Cochran . |
| 3,716,930 | 2/1973 | Brahm . |
| 4,336,661 | 6/1982 | Medrano . |
| 4,590,689 | 5/1986 | Rosenberg . |
| 4,991,317 | 2/1991 | Lakic . |
| 4,995,173 | 2/1991 | Spier . |
| 4,999,932 | 3/1991 | Grim . |
| 5,224,278 | 7/1993 | Jeon . |
| 5,741,568 | 4/1998 | Rudy . |

FOREIGN PATENT DOCUMENTS

| | | |
|---|---|---|
| 17277 | 8/1907 | Germany . |
| 2901084 | 7/1980 | Germany . |
| 13393 | 7/1901 | United Kingdom . |
| 520514 | 4/1940 | United Kingdom . |

*Primary Examiner*—Ted Kavanaugh
*Attorney, Agent, or Firm*—Michael Ebert

[57] ABSTRACT

An innersole for a sneaker or other athletic shoe that is adjustable to impart to the innersole characteristics appropriate to the particular use to which the shoe is to be put by the wearer, such as jumping, jogging or running. The innersole, contoured to fit in the shoe, is composed of a flexible foam plastic pad encased in a plastic film envelope. Extending from the rear of the envelope and projecting through the counter of the shoe is a vent tube having a control valve therein. When the valve is fully open, the insole then acts as a shock-absorbing cushion whereby when depressed by the foot of the wearer, air is expelled from the innersole through the open valve, and when pressure is released, the innersole then inhales air as it recovers its normal shape. When the valve is fully closed to hermetically seal the envelope, the innersole then functions as a pneumatic spring to impart bounce thereto. The degree of bounce imparted to the innersole relative to its shock absorbing characteristics is adjustable by partially opening the valve.

7 Claims, 1 Drawing Sheet

ADJUSTABLE INNERSOLE FOR ATHLETIC SHOE

BACKGROUND OF THE INVENTION

1. Field of Invention

This invention relates generally to innersoles for sneakers and other athletic shoes, and more particularly to an innersole that is adjustable to impart thereto characteristics appropriate to the particular use for which the shoe is to be put.

2. Status of Prior Art

In a shoe, the insole is the innersole of the shoe overlying the outer sole. When the insole is an extra strip of material that is put inside the shoe for comfort or protection, it is then referred to as an innersole. In an athletic shoe such as a sneaker, the requirements of an innersole depend on the particular use to which the sneaker is to be put.

A wearer of sneakers engages in various forms of sports activity, such as playing tennis or basketball, jogging, jumping, long distance running as well as racing at high speed for a short distance. In these activities, the ground may in some cases be paved and hard, while in other cases it may be formed of dirt, grass or clay.

Hence an innersole whose characteristics are suitable for one type activity may be inappropriate for other types. For example, when running in a marathon on paved city streets for twenty miles or more, then the sneakers best suited for this purpose should have shock absorbing characteristics, for otherwise the runner will experience foot pain as he continues to pound hard paved surfaces.

But if the same runner is in a race over a short distance on a dirt track, and his speed is of primary concern, then what is called for is an innersole that has spring-like characteristics which impart bounce to the sneaker to increase the runner's speed. And in many instances what is called for is an innersole whose properties are a cross or compromise between shock-absorbing and spring characteristics.

Of prior art interest is the patent to Rudy U.S. Pat. No. 5,741,568 disclosing a fibrous shock-absorbing cushion for a shoe encapsulated in a hermetically sealed envelope.

In Signore U.S. Pat. No. 4,610,099, a shoe is provided with a shock absorbing inflated air pocket. Also providing air-filled bladders in a shoe is the Johnson U.S. Pat. No. 4,446,634.

The athletic shoe disclosed in Pettibone U.S. Pat. No. 5,671,552 is designed for jumping activities, the sole of the shoe being provided with several compressible helical springs as well as an inflated air bladder. Hence this shoe combines mechanical and pneumatic actions.

The Medrano U.S. Pat. No. 4,571,853 discloses a shoe insert formed of a foam plastic pad enclosed within a plastic film envelope having holes therein whereby when the insert is compressed by the foot of the wearer, air expelled from the pad is discharged through the holes in the envelope to ventilate the foot received in the shoe.

SUMMARY OF INVENTION

In view of the foregoing, the main object of this invention is to provide an innersole for a sneaker or other athletic shoe which is adjustable to impart to the innersole whatever characteristics are best suited for the particular use to which the shoe is to be put.

Thus if the wearer intends to engage in jumping activity, then the adjusted characteristics are appropriate to this activity, but if the wearer intends to hike along a long mountain trail or to run a distance of over 20 miles, or to play basketball, then the characteristics of the innersole are adjusted to accommodate the conditions encountered in these activities.

More particularly an object of this invention is to provide an innersole which is insertable in a sneaker or other athletic shoe, or is incorporated in the structure of the shoe.

Yet another object of this invention is to provide an innersole of the above type which is durable and can therefore survive rough treatment, the innersole being relatively inexpensive to manufacture.

Briefly stated these objects are accomplished by an innersole for a sneaker or other athletic shoe that is adjustable to impart to the innersole characteristics appropriate to the particular use to which the shoe is to be put by the wearer, such as jumping, jogging or running. The innersole, which is contoured to fit in the shoe, is composed of a flexible foam plastic pad encased in a plastic film envelope. Extending from the rear of the envelope and projecting through the counter of the shoe is a vent tube having a control valve therein. When the valve is fully open, the insole then acts as a shock-absorbing cushion whereby when depressed by the foot of the wearer air is expelled from the innersole through the open valve, and when pressure is released, the innersole then inhales air as it recovers its normal shape. When the valve is fully closed to hermetically seal the envelope, the innersole then functions as a pneumatic spring to impart bounce thereto. The degree of bounce imparted to the innersole relative to its shock absorbing characteristics is adjustable by partially opening the valve.

BRIEF DESCRIPTION OF DRAWING

For a better understanding of the invention as well as other objects and further features thereof, reference is made to the following detailed description to be read in conjunction with the accompanying drawings, wherein.

DESCRIPTION OF INVENTION

Figure 1:
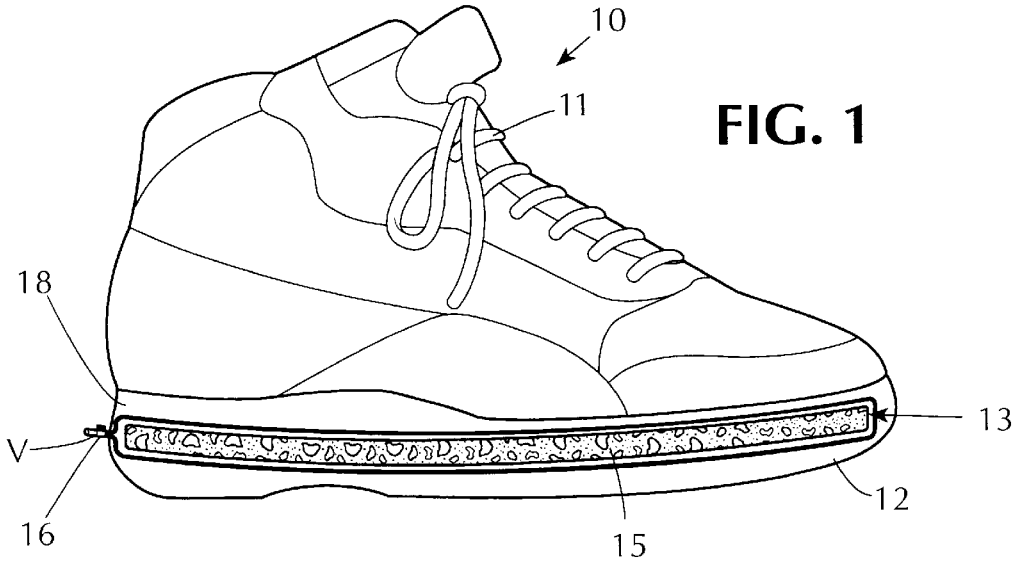
FIG. 1 is a perspective view of a sneaker having installed therein an innersole in accordance with the invention.

The Innersole:

Referring now to FIG. 1 there is shown an athletic shoe which by way of example is a sneaker 10, tied by lacing 11, the sneaker having a molded one piece sole 12. Overlying sole 12 within the sneaker is an innersole 13 in accordance with the invention. The innersole is contoured to conform to the shape of the shoe and to fit snugly therein.

Innersole 13 is composed of a contoured pad 14 of open-cell, flexible foam plastic material, such as polyurethane whose density is such as to provide shock absorbing cushioning characteristics. Assuming that the typical wearer of the shoe weighs 145 pounds, the density of the foam plastic material should be such that when the full weight of the wearer is imposed on the pad, the pad should then be depressed to half its normal thickness; assuming a normal thickness of ⅝th of an inch. Thus FIG. 3 shows pad 14 is an uncompressed state and FIG. 4 shows the same pad in a compressed state.

When the open-cell foam plastic pad 14 is compressed, air is expelled therefrom, and when the pressure is released, the pad then inhales air to resume its normal shape and size.

Figure 2:
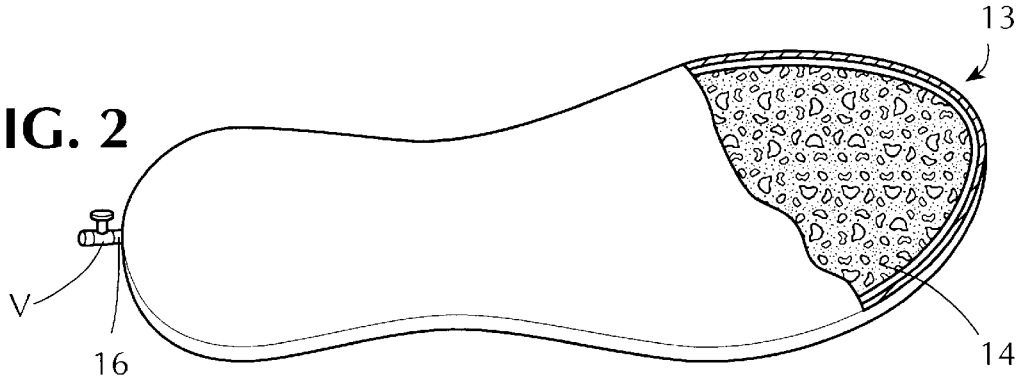
FIG. 2 is a separate view of the innersole whose outer envelope is cut away to expose the foam plastic pad.
Figure 3:
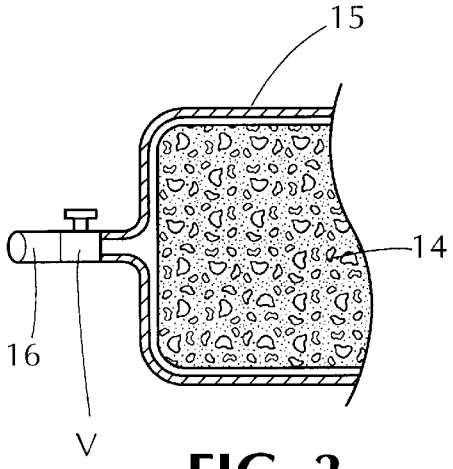
FIG. 3 is a longitudinal section taken through the innersole.
Figure 4:
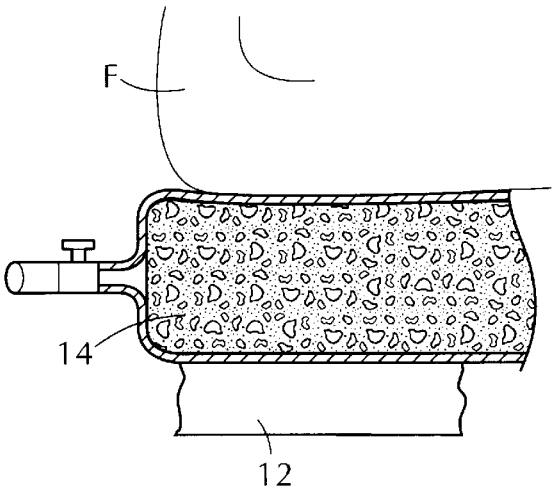
FIG. 4. is a longitudinal section taken through the innersole when the contact valve is fully open and the innersole is compressed by the foot of the wearer of the shoe.

Pad 14 is encased in an envelope 15 which conforms to the contours of the pad in its uncompressed state as shown in FIGS. 2 and 3. Envelope 15 is formed of high-strength, synthetic plastic flexible film material that is non-stretchable, such as biaxially-oriented Mylar (polyester) or polypropylene.

Integrated with envelope 15 are extending from the rear end thereof is a vent tube 16 which may be of the same material as the envelope, the vent tube communicating with the interior of the envelope. Tube 16 is provided with a miniature control valve V which is capable of being fully open or fully closed, or of being more or less partially open. Tube 16 projects through an opening in the counter 18 of the shoe so that valve V can be adjusted by the wearer of the shoe.

In practice, innersole 13 may take the form of an insert that is insertable into a finished athletic shoe and may therefore be removed therefrom when necessary to clean the interior of the shoe. Or the innersole may be incorporated into the structure of a shoe by sandwiching the innersole between the sole 12 and an leather insole. But in either case, it is essential that tube 16 project through an opening in the counter of the shoe so that its control valve V can be adjusted as desired.

Operation of Innersole:

Open-Valve State: When valve V is fully open, pad 14 is then free to breathe in the sense that when foot pressure is applied to the innersole by foot F, as shown in FIG. 4, air expelled from the pad is discharged into the atmosphere through tube 16. And when this pressure is released, air drawn through tube 16 is inhaled by the pad as it recovers its normal shape and size.

In the open-valve state, pad 14 acts as a shock-absorbing cushion for the foot of the wearer. When the wearer brings his sneakers or athletic shoe to bear on a hard surface, the impact of the sneaker with this hard surface is conveyed to the foot through the pad whose cushioning properties serve to absorb the shock of impact.

Hence in the open valve state, innersole 13 is useful for those athletic activities in which the foot is repeatedly subjected to shock forces, as in jumping, jogging or in long distance running.

Closed Valve State: When control valve V is fully closed, then plastic film envelope 15 is hermetically sealed to entrap the air therein and acts as a pneumatic spring. In this state, when the innersole is subjected to foot pressure, the air within the envelope is compressed, for it cannot be expelled therefrom. And when foot pressure is released, the air expands to cause the envelope to regain its normal size and shape.

Hence in this state, the innersole acts as if it included an array of compressible springs distributed throughout the envelope. The innersole in this closed state imparts bounce characteristics to the shoe.

Such bounce characteristics are desirable when the wearer of the shoe is pole vaulting, playing basketball, racing over a short distance or engaging in any other sports activity where the objective is speed rather than cushioning.

In the closed valve state, it is as if the wearer of the shoe were wearing springs, for each time his foot engages the ground, the resultant compression of the springs imparts lift to the shoe as the springs then expand and thereby assist the wearer in his activity.

Partial Valve State: When the valve is partially open, the characteristics of the innersole are a compromise between those produced by an open valve state and by a closed valve state that depends on the degree to which the valve is opened.

Thus if the valve is only slightly open, air has difficulty in escaping through vent tube 16 so that while some cushioning is provided by pad 14, the innersole acts largely as a pneumatic spring. But when the valve is half open, then the innersole retains some pneumatic spring characteristics, but it also exhibits a good measure of shock absorbing characteristics.

It is for the wearer to decide the extent to which valve V is to be partially opened, and this decision is arrived at empirically. Thus the wearer may find out that on a long hike, cushioning is far more useful than bounce, and he will adjust the valve accordingly. But in a long distance marathon race, the wearer may find out that while cushioning affords greater comfort and endurance, it is at the expense of speed, and without speed he will fall behind other runners.

An innersole having a control valve to vary the ratio between shock-absorbing and bounce characteristics makes it possible for the wearer of the athletic shoe to custom fit these characteristics to his existing needs.

While there has been shown and described a preferred embodiment of an adjustable innersole for an athletic shoe in accordance with the invention, it will be appreciated that many changes and modifications may be made therein without, however, departing from the essential spirit thereof. Thus while an innersole in accordance with the invention is intended for athletic shoes, it also may be incorporated in sandals and other shoes that normally are not regarded as athletic shoes. And in practice a layer of tread material may be laminated to the upper surface of the envelope so that the foot inserted in the shoe engages this layer.

I claim:

1. An innersole for a shoe having a sole and a counter, the innersole overlying the sole and being engageable by a foot of the wearer to impart shock absorbing and/or bounce characteristics to the shoe, said innersole comprising:

A. a compressible pad edge-contoured to conform to contours of the shoe in which the innersole is inserted, said pad being formed of open-cell, flexible foam plastic material;

B. an envelope encasing the pad formed of plastic film material; and

C. a vent tube extending from the envelope and projecting through the counter of the shoe to communicate with ambient air, said tube having a control valve therein that is adjustable to fully open, to partially open or to fully close the valve, whereby in an open-state of the valve, air is free to pass through tube and the innersole which includes said compressible pad then acts as a shock absorbing cushion, and in a closed state of the valve in which the envelope is hermetically sealed, the innersole then acts as a pneumatic spring, the innersole when the valve is partially open then having both shock absorbing and pneumatic spring characteristics in a ratio that depends on the degree to which the valve is partially open.

2. An innsersole as set forth in claim 1, in which the shoe is a sneaker and the innersole is insertable in the sneaker.

3. An innersole as set forth in claim 1, in which the shoe is an athletic shoe and the innersole is incorporated in the shoe, the innersole being sandwiched between the sole and an insole.

4. An innersole as set forth in claim 1, in which the pad is formed of a flexible polyurethane foam.

5. An innsersole as set forth in claim 4, in which the pad is formed of polyurethane foam whose density is such that when the innersole is subjected to the weight of a typical wearer, its thickness is reduced to about half its normal thickness.

6. An innersole as set forth in claim 1, in which the envelope is formed of a non-stretchable plastic film.

7. An innersole as set forth in claim 6, in which the plastic film is bi-axially oriented.

* * * * *